United States Patent [19]

Tanaka et al.

[11] Patent Number: 4,857,677

[45] Date of Patent: Aug. 15, 1989

[54] DIAL DEVICE

[75] Inventors: Tomeo Tanaka, Kanagawa; Toshikazu Oda, Atsugi, both of Japan

[73] Assignee: Anritsu Corporation, Tokyo, Japan

[21] Appl. No.: 162,061

[22] Filed: Feb. 29, 1988

[30] Foreign Application Priority Data

Mar. 4, 1987 [JP] Japan ..... 62-50978

[51] Int. Cl.[4] ..... H01H 9/00

[52] U.S. Cl. ..... 200/5 R; 200/14; 200/17 R

[58] Field of Search ..... 200/5 R, 5 A, 6 R, 6 A, 200/11 R, 14, 61.54, 52 R, 61.27, 61.85, 155 R, 336, 316, 17 R, 18

[56] References Cited

U.S. PATENT DOCUMENTS

| | | | |
|---|---|---|---|
| 2,106,925 | 2/1938 | Hagler | 200/61.55 X |
| 3,005,055 | 10/1961 | Mattke | 200/6 A X |
| 3,287,512 | 11/1966 | Gertsch | 200/316 X |
| 4,374,310 | 2/1983 | Kato et al. | 200/61.54 |
| 4,387,279 | 6/1983 | Brevick | 200/61.54 |
| 4,394,546 | 7/1983 | Harumatsu | 200/5 R |

FOREIGN PATENT DOCUMENTS

| | | |
|---|---|---|
| A20114959 | 8/1984 | European Pat. Off. . |
| 62-15375 | 4/1987 | Japan . |

OTHER PUBLICATIONS

IBM Technical Disclosure Bulletin, "Smart Key"; vol. 28; No. 5; Oct. 1985, pp. 1859, 1860.

JIS (a coaxial type double-throw variable resistor) pp. 19-21.

*Primary Examiner*—J. R. Scott

*Attorney, Agent, or Firm*—Frishauf, Holtz, Goodman & Woodward

[57] ABSTRACT

A dial device houses switches which have functions related to the dial device. An opening is formed at the front end of the dial knob. Switch operating parts for these switches housed in the dial device are exposed through the opening. The switches are attached to a member such as the shaft by which the dial knob is supported, and these switches and their operating parts are left not turned even when the dial knob is turned.

6 Claims, 8 Drawing Sheets

DIAL DEVICE

BACKGROUND OF THE INVENTION

1. Field of the Invention

The present invention relates to a dial device having operating or displaying elements at the front face of the dial knob and more particularly, it relates to a dial device wherein operating or displaying elements such as switches or display lamps related to the function of the dial knob ar arranged at the front face of the dial knob to make smaller that area on the panel where the dial device is attached and to allow the dial device to be operated with more easiness.

2. Description of the Related Art

Dial devices for achieving various kinds of adjustments such as frequency, level and sound volume selections are conventionally attached to various kinds of machines including measurement and audio machines, for example. These dial devices are intended to achieve the various kinds of adjustments in such a way that amounts of their rotated dial knob are converted to electric signals by the rotary encoder or the like.

In the case of these dial devices, however, the diameter of their dial knob must be made large in order to achieve precise adjustments. In addition, a space for allowing a hand of the operator to operate the dial must be provided around the dial knob and this makes it impossible to locate other switches and the like adjacent to the dial knob. When the dial device of this type is to be attached to the operation panel, therefore, that area on the operation panel necessary for the dial device to be attached becomes unexpectedly large.

The other conventional dial device having double shafts is provided to eliminate the above-mentioned drawbacks. This dial device comprises two shafts arranged coaxial to and independent of each other and two dial knobs attached to the shafts and separated from each other in the axial direction of the shafts. In the case of this dial device, however, the operation of the dial knobs becomes troublesome and there is the possibility of mistakenly rotating the one of the dial knobs while operating the other, because the two dial knobs are separated from each other in the axial direction of the shafts.

In order to reduce that area on the operation panel where one of the above-mentioned dial devices is to be attached, such a means as shown in FIG. 1 is proposed these days. In FIG. 1, numeral 1 represents an operation panel, and dial device 3 is attached to operation panel 1. Numeral 3*a* denotes a dial knob. Plural function selecting switches 4*a*, 4*b*, 4*c* and 4*d* are located adjacent to dial knob 3*a* on operation panel 1. These switches 4*a*–4*d* are intended to select the function of dial device 3. When switch 4*a* is made operative, for example, the dial device functions to set a frequency and when switch 4*b* is rendered operative, it functions to set a level. Therefore, this dial device can achieve plural adjustments and make it unnecessary to use four dial devices instead, thereby reducing that area on the operation panel where the dial device is to be attached.

However, the plural function selecting switches must be located adjacent to the dial device, thereby making it insufficient to reduce that area on the operation panel where the dial device is to be attached. Various kinds of electric devices have been small-sized these days and operation panels for these electric devices have also been small-sized accordingly. Many operating elements are therefore closely arranged on this small-sized operation panel. This results in that other switches and the like are arranged adjacent to dial device 3 in addition to function selecting switches 4*a*–4*d*. This makes it impossible and troublesome for the operator to instinctively recognize which the function selecting switches related to dial device 3 are. Further, one of function selecting switches 4*a*–4*d* may be rendered operative because there is the possibility of touching it by hand while operating dial knob 3*a*. Therefore, switches 4*a*–4*d* cannot be located too adjacent to dial knob 3*a*. As the result, the operator must move his hand more exaggeratedly to operate these knob and switches thereby making it difficult to operate them with easiness.

Although the field of invention is different a little from that of the present invention, Japanese Patent Publication Sho/62- 15375 (which was filed by Nissan Automobile Corporation and made public on Apr. 7, 1987) (U.S. Pat. No. 4,374,310) discloses various kinds of switches and the like arranged on a pad in the center of the steering wheel so as to allow the steering wheel and the various kinds of switches to be operated with more easiness.

SUMMARY OF THE INVENTION

The present invention is intended to eliminate the above-mentioned drawbacks. The object of the present invention is therefore to provide a dial device capable of reducing that area on the operation panel where it is to be attached, being operated with more easiness, and preventing it from being mistakenly operated.

According to the present invention, an operating element is arranged on the front face of a dial knob of the dial device and includes typically plural function selecting switches for selecting the function of the dial device. When the dial device is arranged like this, the function selecting switches are not needed to locate adjacent to the dial knob, thereby reducing that area on the operation panel where they are to be arranged. Further, it can be instinctively recognized that these switches are related to the dial device, and the dial knob and the switches can be operated by one hand at the same time or independently of one another, thereby allowing them to be operated with more easiness. Furthermore, the possibility can be reduced that the switches ar mistakenly touched by hand while operating the dial knob, thereby preventing them from being mistakenly operated.

The dial device of this type is designed to meet various kinds of specifications asked by the user and then incorporated into its related machine or the like. It may be therefore that the switches are not necessarily intended to select the function of the dial device. When the dial device of the present invention is used in a system for changing plural parameters such as temperature and pressure, for example, the switches may serve as those for selectively displaying the temperature or pressure on a display element. The display selecting switches can be operated by one hand in this case while operating the dial knob, thereby enabling them to be operated with more easiness. Further, display elements such as the light-emitting diode may be arranged on the front face of the dial knob in addition to the operating elements.

According to the preferred embodiments of the present invention, an opening is formed at the front face of the dial knob, the above-described switches are fixedly attached to a support shaft for the dial knob, buttons for operating these switches are exposed on the front face of the dial knob, and these switches are left not rotated even when the dial knob is rotated. When the dial device is arranged like this, the switch operating buttons can be always left at same positions even if the dial knob is rotated, and when letters are printed on the switch operating buttons, they can be left as they are, that is, they cannot be turned upside down even if the dial knob is rotated.

DETAILED DESCRIPTION OF THE PREFERRED EMBODIMENTS

Figure 1:
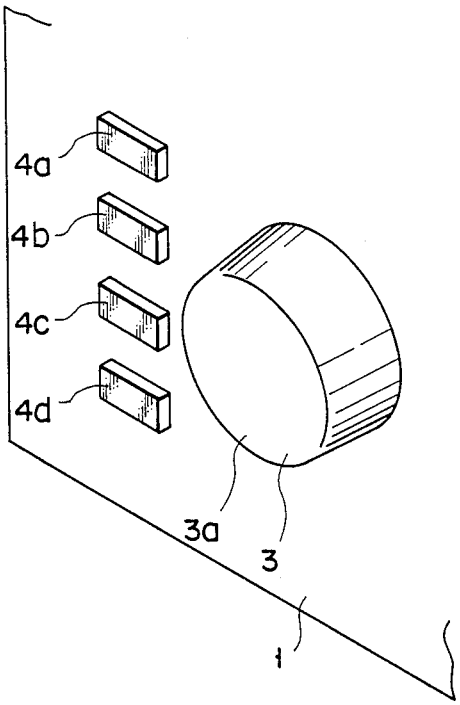
FIG. 1 PRIOR ART
FIG. 1 is a perspective view showing the conventional dial device and function selecting switches arranged adjacent to the dial device.
Figure 2:
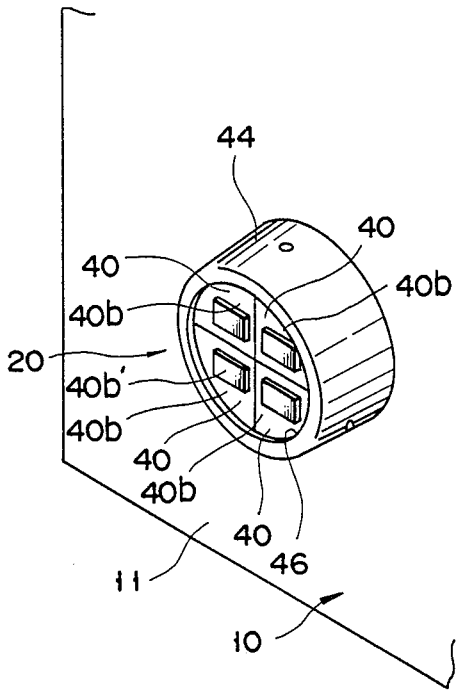
FIG. 2 is a perspective view showing an example of the dial device according to the present invention.

FIGS. 2 through 7 show a first example of the dial device according to the present invention. Numeral 10 represents a housing for a measurement machine, for example, and dial device 20 of the present invention is attached to front panel 11 of the housing. Plural or four function selecting switches are incorporated into dial knob 44 of dial device 20 and their operating key tops 40 are exposed from the front face of dial knob 44.

Figure 3:
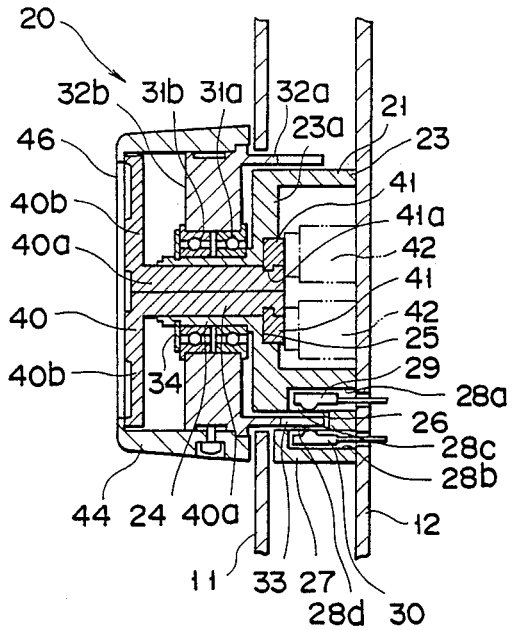
FIG. 3 is a vertically-sectioned view showing the dial device in FIG. 2.
Figure 4:
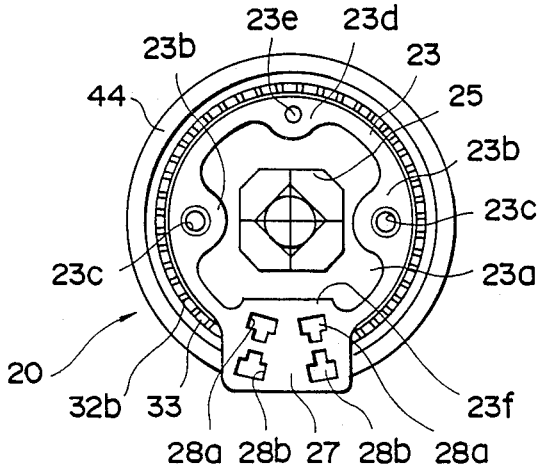
FIG. 4 is a backside view showing the dial device in FIG. 2.
Figure 5:
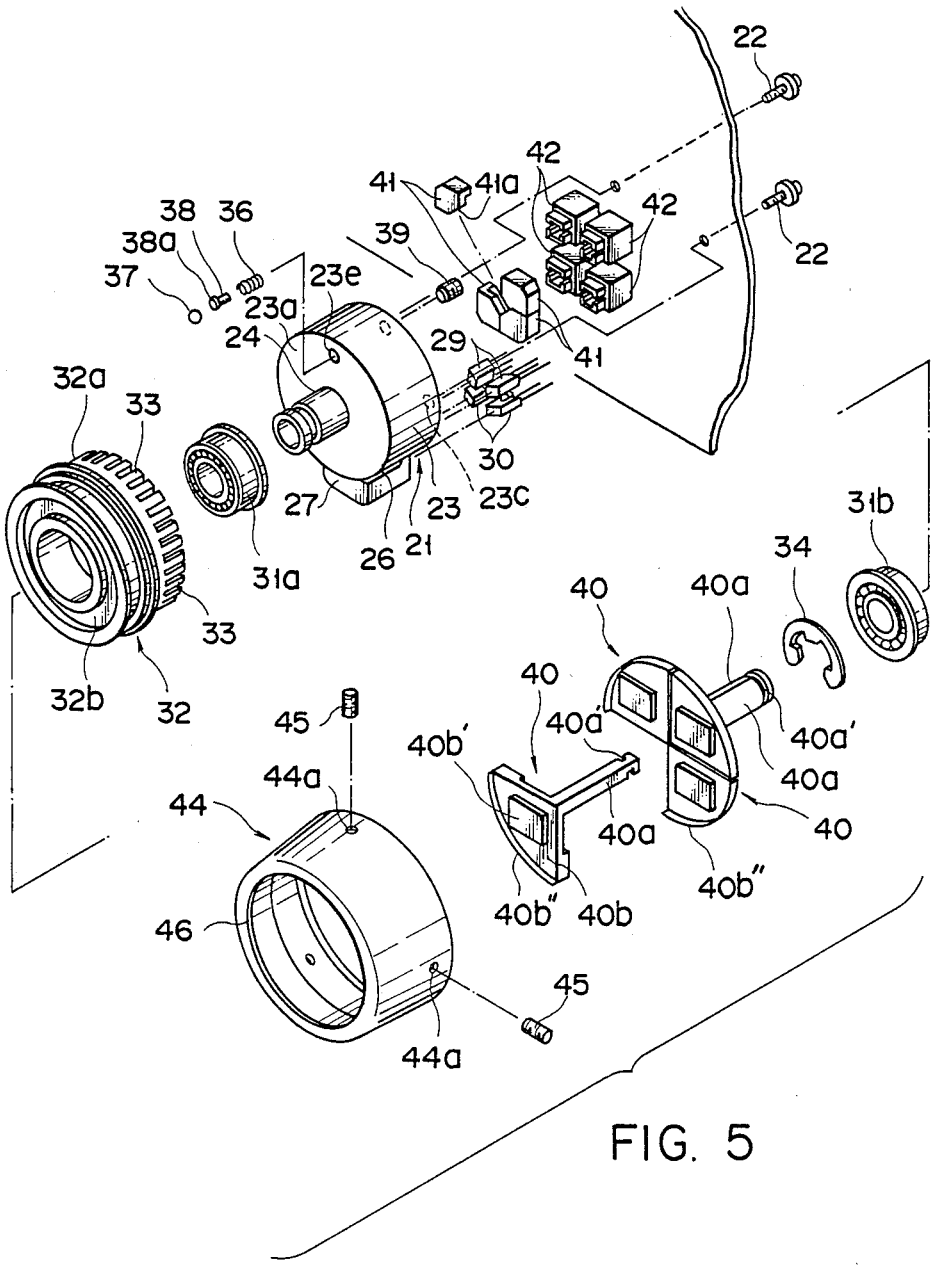
FIG. 5 is a perspective view showing the dial device in FIG. 2 dismantled.
Figure 6:
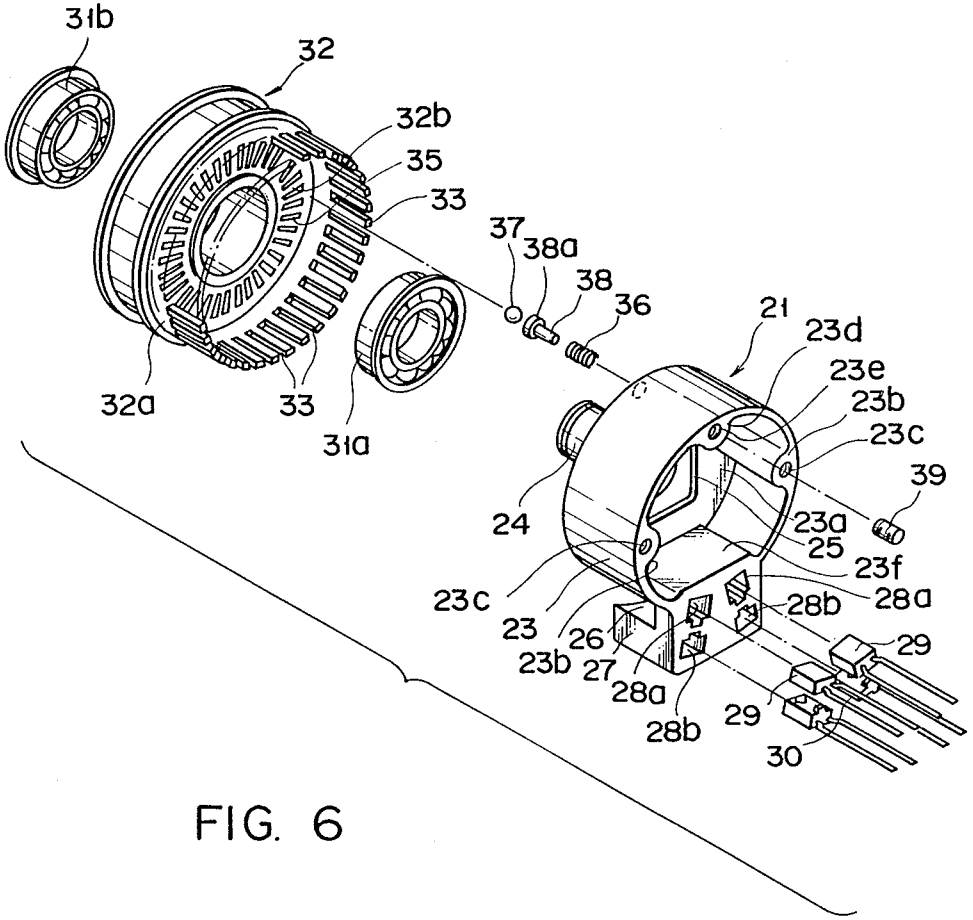
FIG. 6 is a perspective view showing a part of the dial device in FIG. 2 dismantled and seen from a direction reverse to that in FIG. 5.

As shown in FIG. 3, dial device 20 has base 21 which is attached to print base plate 12 of the measurement machine by means of screws 22. Base 21 has hollow cylindrical portion 23, and shaft 24 is projected forward from and integral to the center of flat part 23*a* of this cylindrical portion. Cylindrical portion 23 is provided with two first thick parts 23*b* at an interval of about 180°, each of these thick parts is provided with screw hole 23*c* and screws 22 are screwed into these screw holes, passing through print base plate 12, to attach base plate 21 to the print base plate. Cylindrical portion 23 is also provided with second thick part 23*d* separated from first thick parts 23*b* by 90° and a through-hole 23*e* is formed passing through the thick part 23*d* in the axial direction thereof.

Substantially square recess 25 is formed on the inner face of the center of flat part 23*a* of base 21 and this square recess 25 is chamfered at the rim thereof.

Cylindrical portion 23 of base 21 is also provided with third thick part 23*f* separated from second thick part 23*d* by 180°. This third thick part is projected inward and outward at one end of cylindrical portion 23, and wall 27 is projected forward from the outwardly-projected portion of the third thick part. Arc groove 26 is provided between wall 27 and the outer circumference of cylindrical portion 23. Housing recesses 28*a* and 28*b* opposite to each other are formed in thick part 23*f* and wall 27, respectively, sandwiching arc groove 26 between them. Two light-emitting elements 29 are housed in housing recesses 28*a* while two light-receiving elements 30 in housing recesses 28*b*. These light-emitting and -receiving elements are opposed to each other through windows 28*c* and 28*d* which are opened toward groove 26. The light-emitting and -receiving elements are of the horizontal type each having a light emitting or -receiving face and lead lines extending perpendicular to the light-emitting or -receiving face. Their lead lines extend in the axial direction of the dial device and are connected to print base plate 12.

Slit ring 32 is freely rotatably attached to shaft 24 of base 21 through two bearings 31*a* and 31*b*. This slit ring 32 is provided with thin cylindrical portion 32*a* and a plurality of slits 33 are formed at one end of this cylindrical portion with a certain interval interposed between these slits. Cylindrical portion 32*a* is arranged enclosing cylindrical portion 23 of base 21 and entering into groove 26. When slit ring 32 is rotated, therefore, cylindrical portion 32*a* having a plurality of slits 33 is moved between light-emitting and -receiving elements 29 and 30 and the number of slits is detected by these elements, so that the amount of rotated slit ring 32 can be converted to an electric signal.

An E ring 34 is fitted onto the foremost end of shaft 24 to prevent slit ring 32 from coming out of shaft 24.

A plurality of click grooves 35 are radially formed on the inner face of flat portion 32*b* of slit ring 32 and they are located corresponding to slits 33. Ball 37, receiving member 38 and compression spring 36 are housed in through-hole 23*e* of base 21 and one end of spring 36 is contacted with screw 39 while the other end thereof with flange 38*a* of receiving member 38. Ball 37 is urged against flat portion 32*b* of slit ring 32 by means of spring 36, and it is fitted into click grooves 35 to create clicks when slit ring 32 is rotated.

Shaft 24 of base 21 is made cylindrical. Plural or four operating key tops 40 are freely slidably guided in the axial direction by cylindrical shaft 24. Each of key tops 40 includes slidable shaft portion 40*a* having a fan-like section which is created when column is divided into four along the axial direction thereof, and front plate 40*b* also having a fan-like shape which is created when a disk is divided into four equal parts. These slidable shaft portions 40*a* are freely slidably fitted into shaft 24 and key tops 40 are independently of one another and freely slidably guided in the axial direction.

Four square contact members 41 are fitted into square recess 25 on the inner face of flat part of base 21. Fitting part 40*a*′ is formed at the foremost end of each of slidable shaft portions 40*a* of key tops 40 and these fitting parts are fitted onto fitted parts 41*a* each formed at one corner of contact member 41. Key tops 40 are thus prevented from coming out of shaft 24 by contact members 41, which are therefore moved together with key tops 40 in the axial direction.

Four switches 42 which correspond to contact members 41 are attached to print base plate 12. These switches are intended to select the function of the dial device in this case. A spring (not shown) is housed in each of switches 42 and activating elements (not shown) of switches 42 are urged against backsides of their corresponding contact members. When front plate 40*b* of key top 40 is pushed by finger, therefore, the key top is slid together with its corresponding contact member 41 in the axial direction and this contact member thus slid pushes the activating element of its corresponding switch 42, so that this switch 42 can be made operative. When finger is released from front plate 40*b* of key top 40, this key top 40 is returned to its original position by its corresponding spring housed in switch 42.

Projection 40*b* ′ is formed on front plate 40*b* of each of the key tops and letters for displaying the function of each of key tops or switches 42 are printed on the projection.

Dial knob 44 is fitted onto the outer circumference of slit ring 32 and fixed to slit ring 32 by means of plural screws 45 screwed into screw holes 44*a*. Circular opening 46 is formed at the front face of dial knob 44, leaving a slim rim projected inward from the front end of dial knob 44. Front plates 40*b* of key tops 40 are exposed through opening 46. Front plates 40*b* of key tops 40 are closely contacted with one another. Rim 40*b*″ is erected from the arc side of each of front plates 40*b* and these rims 40*b*″ are closely contacted with the backside of the front rim of dial knob 44. Substantially insignificant clearances are therefore provided between front plates 40*b* and between these front plates and the front rim of dial knob 44, thereby preventing matters such as dust from entering into the dial device.

Figure 7:
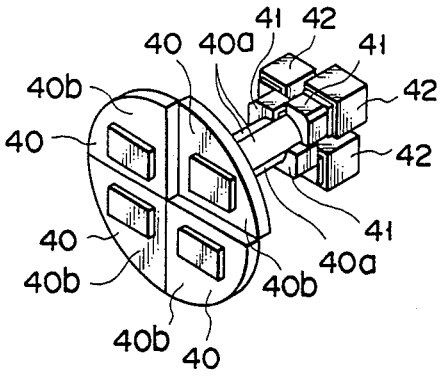
FIG. 7 is a perspective view showing only a switch portion of the dial device in FIG. 2.

In the case of the above-described dial device, front plate 40*b* of key top 40 which corresponds to a function is pushed by finger at first to select the function. Only that key top 40 which is pushed is slid, as shown in FIG. 7, to render switch 42 operative through contact member 41. The function of the dial device is thus selected. When the function of this dial device is to be changed to another, the key top which corresponds to the another function is pushed.

Figure 8:
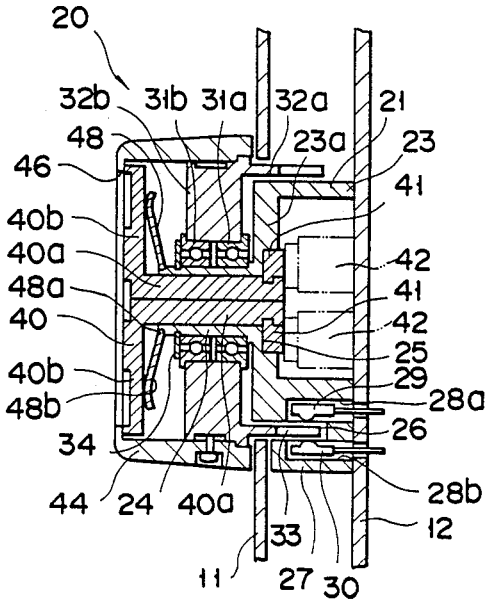
FIG. 8 is a vertically-sectioned view, similar to FIG. 3, showing another example of the dial device according to the present invention.
Figure 9:
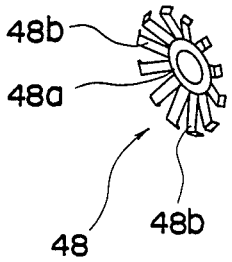
FIG. 9 is a perspective view showing a spring member employed by the dial device in FIG. 8.
Figure 10:
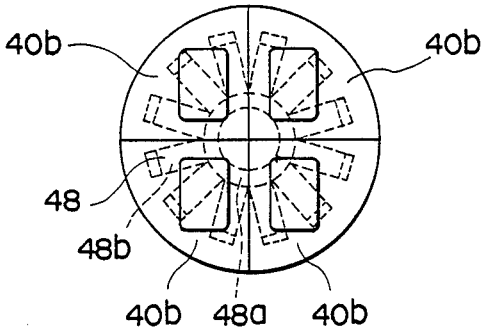
FIG. 10 is a front view showing a switch portion of the dial device in FIG. 8.

Slidable shaft portions 40*a* of key tops 40 are located in the center of the dial knob in the case of the above-described dial device. When fan-shaped front plate 40*b* is pushed, therefore, bending load acts on slidable shaft portion 40*a* to sometimes prevent its smooth slide. This can be eliminated when relative dimensions between the slidable shaft portions and the center hole of the shaft are appropriately selected and designed and when the material of these members is rightly selected as well. This can be eliminated with more reliability when the dial device has such an arrangement as shown in FIGS. 8 through 10.

This second example of the dial device is provided with coned disc spring 48 and it is same as the one shown in FIGS. 2 through 7 except this coned disc spring 48. Coned disc spring 48 includes ring 48a having an opening in the center thereof, and plural spring arms 48*b* extending radially and outward from the ring. Coned disc spring 48 is fitted onto stepped portion 24*b* on the foremost end of shaft 24 at ring 48*a* thereof. Foremost ends of spring arms 48*b* are contacted with front plates 40*b* at those positions on their backsides which are separated remote from slidable shaft portions 40*a*, as shown in FIGS. 8 and 10. When key top 40 is pushed, therefore, spring arms 48*b* of coned disc spring 48 are elastically deformed and their repelling force acts on the backsides of front plates 40*b*. A part or all of the bending load which acts on slidable shaft portions 40*a* when no coned disc spring 48 is provided can be cancelled by the repelling force of spring arms 48*b*.

Figure 11:
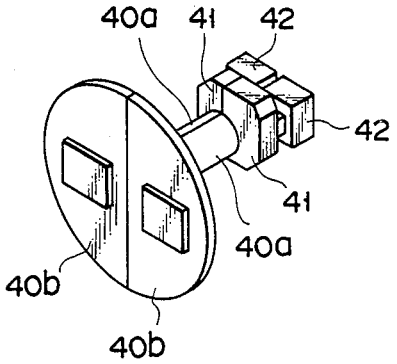
FIG. 11 is a perspective view showing a switch portion employed by a further example of the dial device according to the present invention.
Figure 12:
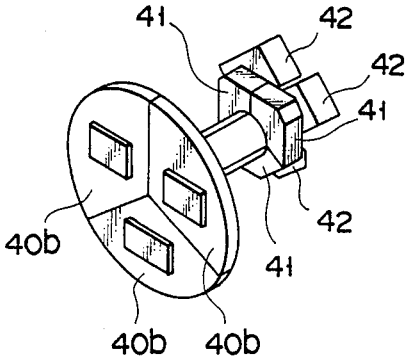
FIG. 12 is a perspective view showing a switch portion employed by a still further example of the dial device.according to the present invention.

Four switches and four key tops are employed by the above-described embodiments, but the number of these switches and key tops can be optionally selected. FIG. 11 shows a case where two key tops and two switches are employed and FIG. 12 shows another case where three switches and three key tops are employed. Front plate 40*b* of each of the key tops has such a fan shape as created when a disc is divided into two or three parts.

Figure 13:
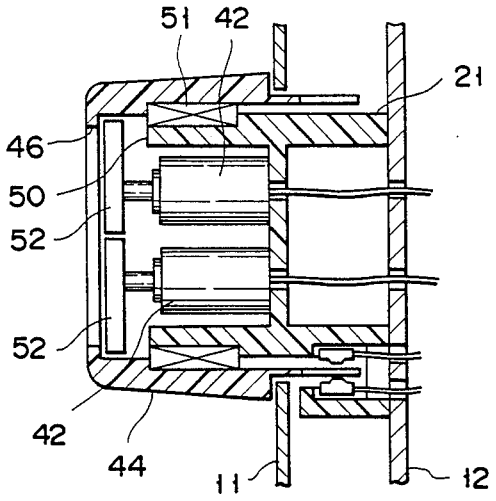
FIG. 13 is a vertically-sectioned view showing a still further example of the dial device according to the present invention.

FIG. 13 shows a third example of the dial device according to the present invention. Cylindrical shaft 50 having a large diameter is projected forward from base 21 and dial knob 44 is freely rotatably supported by cylindrical shaft 50 through needle bearing 51 and the like. Plural switches 42 is housed in cylindrical shaft 50 and switch operating buttons 52 are attached directly to their respective switches 42. Switch operating buttons 52 are exposed through opening 46 at the front end of dial knob 44.

Figure 14:
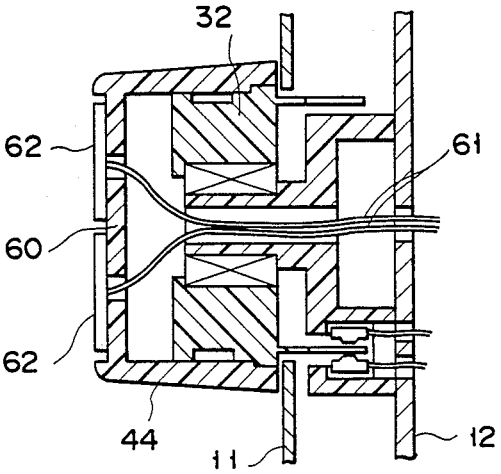
FIG. 14 is a vertically-sectioned view showing a still further example of the dial device according to the present invention.

FIG. 14 shows a fourth example of the dial device according to the present invention. Thin membrane switches 62 are attached to the front face of front wall 60 of dial knob 44. Lead lines 61 extend backward from membrane switches 62, passing through the hollow shaft by which the dial knob is supported, and they are then connected to the print base plate. The turning of dial knob 44 is made possible because lead lines 61 can be twisted. Membrane switches 62 are turned together with dial knob 44, but the functions of these membrane switches may be displayed not by letters but by colors and shapes.

It should be understood that the present invention is not limited to the above-described embodiments and that various changes and modifications can be made without departing from the scope and spirit of the present invention.

What is claimed is:

1. A dial device adapted to be mounted on a base plate, said dial device comprising:

a hollow base mountable on said base plate;

a cylindrical shaft, mounted to said base and projecting forwardly from said base, said cylindrical shaft having a through-hole therein extending in the axial direction thereof, a front end of said through-hole being open at a front surface of said shaft, and a back end of said through-hole opening into a space extending inside of said hollow base;

a dial knob, rotatably supported by said shaft, said dial knob having a front surface which has an opening therein;

means coupled to said dial knob for converting a rotated amount of said dial knob into an electrical signal;

at least one switch mounted in the space inside of said hollow base; and at least one key top, said at least one key top including a shaft portion freely slidably passing through said through-hole of said shaft, a back end of said shaft portion of said key top being mechanically connected to said at least one switch so as to operate said at least one switch via said shaft portion of said at least one key top, a front end of said shaft portion projecting forwardly from said cylindrical shaft and having a front plate thereon, said front plate being exposed through said opening of said dial knob;

said at least one switch being operable by depressing said front plate of said at least one key top so that said shaft portion of said at least one key top slides rearwardly relative to said cylindrical shaft to operate said at least one switch.

2. The dial switch of claim 1, wherein a plurality of said switches are provided in said space inside of said hollow-base, and a plurality of said key tops of the same number as said switches are provided.

3. The dial switch of claim 2, wherein at least a section of said through-hole of said cylindrical shaft is circular, at least a section of said shaft portion is fan-shaped, and said front plate is fan-shaped.

4. The dial switch of claim 3, further comprising:

disk spring means including plate members, a ring portion and a plurality of transformable elastic spring arms extending radially and outwardly from said ring portion, said ring portion being attached to an outer periphery of a front end of said cylindrical shaft; and said elastic spring arms having tip portions which touch a back surface of a front plate of a key top and push it forward, and when said front plate of said at least one key top is depressed, a bending load generated at said shaft portion of said at least one key top is reduced by the pushing force of said elastic spring arms.

5. The dial switch of claim 4, further comprising:

disk spring means including plate members, a ring portion and a plurality of transformable elastic spring arms extending radially and outwardly from said ring portion, said ring portion being attached to an outer periphery of a front end of said cylindrical shaft; and said elastic spring arms having tip portions which touch a back surface of a front plate of a key top and push it forward, and when said front plate of said at least one key top is depressed, a bending load generated at said shaft portion of said at least one key top is reduced by the pushing force of said elastic spring arms.

6. The dial switch of claim 1, further comprising:

disk spring means including plate members, a ring portion and a plurality of transformable elastic spring arms extending radially and outwardly from said ring portion, said ring portion being attached to an outer periphery of a front end of said cylindrical shaft; and said elastic spring arms having tip portions which touch a back surface of said front plate of at least one key top and push it forward, and when said front plate of said at least one key top is depressed, a bending load generated at said shaft portion of said at least one key top is reduced by the pushing force of said elastic spring arms.

* * * * *